US008596923B2

(12) United States Patent
Oldsen et al.

(10) Patent No.: US 8,596,923 B2
(45) Date of Patent: Dec. 3, 2013

(54) SYSTEM AND METHOD FOR MINE ROOF COUNTER BORE AND CABLE BOLT HEAD SECUREMENT THEREIN

(75) Inventors: John G. Oldsen, Butler, PA (US); John C. Stankus, Canonsburg, PA (US); Demrey G. Brandon, Pittsburgh, PA (US); Joey B. Blankenship, Bluefield, WV (US)

(73) Assignee: FCI Holdings Delaware, Inc., Pittsburgh, PA (US)

( * ) Notice: Subject to any disclaimer, the term of this patent is extended or adjusted under 35 U.S.C. 154(b) by 368 days.

(21) Appl. No.: 11/500,173

(22) Filed: Aug. 7, 2006

(65) Prior Publication Data

US 2007/0036617 A1 Feb. 15, 2007

Related U.S. Application Data

(60) Provisional application No. 60/706,827, filed on Aug. 9, 2005.

(51) Int. Cl.
*E21D 20/00* (2006.01)

(52) U.S. Cl.
USPC ..... 405/259.4; 405/259.1

(58) Field of Classification Search
USPC ..... 405/259.1–259.6, 262, 302.1
See application file for complete search history.

(56) References Cited

U.S. PATENT DOCUMENTS 654,861 A 7/1900 Tynan
3,090,203 A 5/1963 Durget
3,238,731 A * 3/1966 Seifert et al. ..... 405/302.1
4,079,766 A 3/1978 Conley et al.
4,523,881 A 6/1985 Ringe
4,708,559 A 11/1987 Locotos
5,064,311 A 11/1991 Giroux et al.
5,259,703 A 11/1993 Gillespie
5,511,909 A 4/1996 Calandra, Jr. et al.
5,586,839 A 12/1996 Gillespie
5,628,587 A 5/1997 Lesslie
5,769,570 A 6/1998 Stankus et al.
5,791,823 A 8/1998 Blakley et al.
5,791,824 A 8/1998 Radtke
5,791,828 A 8/1998 Fergusson
5,829,922 A * 11/1998 Calandra et al. ..... 405/302.2
5,934,855 A 8/1999 Osterle et al.
5,954,456 A 9/1999 Bowles
6,056,482 A 5/2000 Calandra, Jr. et al.
6,428,243 B1 8/2002 Hutchins
6,457,909 B1 10/2002 Xu et al.
6,626,610 B1 * 9/2003 Seegmiller ..... 405/259.5
6,648,557 B1 11/2003 Morrow et al.
6,682,268 B2 1/2004 Robertson, Jr. et al.
6,881,015 B2 4/2005 Wallstein et al.
2003/0143038 A1 7/2003 Babcock
2004/0161316 A1 8/2004 Locotos et al.

* cited by examiner

*Primary Examiner* — Benjamin Fiorello
(74) *Attorney, Agent, or Firm* — The Webb Law Firm

(57) ABSTRACT

A mine roof support includes a substantially dome-shaped plate including a curved portion having a first side and a second side. The mine roof support includes a drive end such as a barrel and wedge assembly, a nut or a forged head. The first side of the plate is adapted to mate with a recess defined in a mine roof. A top portion of the drive head may be contoured to substantially match the contour of the second side of the plate. A drill bit tool used to create the recess includes a first drill bit situated at one end of the drill bit tool and a second drill bit situated near an opposite end of the drill bit tool, wherein the drill bit tool is adapted to drill a bore hole and the recess. A method for supporting the mine roof utilizes the mine roof support.

4 Claims, 11 Drawing Sheets

SYSTEM AND METHOD FOR MINE ROOF COUNTER BORE AND CABLE BOLT HEAD SECUREMENT THEREIN

CROSS REFERENCE TO RELATED APPLICATIONS

This application claims the benefit of U.S. Provisional Patent Application No. 60/706,827, filed Aug. 9, 2005, and entitled "System and Method for Mine Roof Counter Bore and Cable Bolt Head Securement Therein," the contents of which are incorporated herein by reference.

BACKGROUND OF THE INVENTION

1. Field of the Invention

The present invention relates generally to a mine roof support and, more particularly, to a system and method for creating a mine roof counter bore adapted to receive a crater plate and cable bolt head therein.

2. Description of Related Art

In mine work, such as coal mining, or in underground formations such as tunnels or other excavations, it is necessary to reinforce or support the roof and/or walls of the excavation to prevent rock falls or cave-ins. Among the most common means presently in use for effecting such support are cable bolts or other suitable elongated members, such as rod bolts, which are inserted into bore holes and exposed to a resin mixture or anchored therein to hold a metal support or bearing plate in tight engagement with the roof or wall surface. With respect to cable bolts, a resin system introduces resin capsules or cartridges into the bore hole and then advances the capsules to a blind end of the bore hole by the cable bolt backing the capsules. The spinning of the cable bolt ruptures the capsules and mixes the resin system supplied. Examples of prior art cable bolt arrangements are disclosed in U.S. Pat. Nos. 6,428,243; 5,586,839; and 5,064,311.

Each of the cable or rod bolts in the aforementioned prior art utilizes either a barrel and wedge assembly or a bolt head, respectively, to secure the metal support or bearing plate against the roof. Therefore, for example, the barrels of the cable bolts extend into the usable walk/crawl or transportation space in a mine, as defined by the distance from the floor to the ceiling of a mine tunnel. FIG. 1 depicts a prior art cable bolt including a multi-strand cable 3 secured to a barrel and wedge assembly 2 and situated with respect to a roofline of a mine. A washer 4 may be secured between a prior art bearing plate 6 and an existing barrel 8. A drive head, such as a nut 9, may be attached to a free end of the cable 3. An exemplary height of the prior art barrel and wedge assembly 2 is approximately three inches. Accordingly, several inches (not including the thickness of the prior art bearing plate 6) of material extends below the roofline. The prior art barrel and wedge assembly 2 used in connection with typical low-clearance tunnels requires that due care be exercised while moving within the tunnel, as the extending bolt heads may be engaged by moving equipment or mine personnel.

SUMMARY OF THE INVENTION

Accordingly, there is a need to provide a mine roof support that limits the extent a bolt head protrudes beyond a roofline of a tunnel. Specifically, a system and method are needed for creating a mine roof counter bore adapted to receive a plate to be seated therein and a portion of a mine roof bolt therein. It is to be understood that the term mine roof bolt is to encompass a cable bolt, a rod bolt, a torque tension bolt and the like.

Accordingly, either a barrel of a cable bolt or a head of a rod bolt may be sufficiently recessed within a recess of the plate to provide more vertical clearance within the tunnel. The resultant mine roof support should be cost-effective, easily installable and provide sufficient structural support for the roof. The foregoing need for an improved mine roof support is met by the present invention.

The present invention includes a mine roof support for use with a recess formed within a mine roof. The mine roof support includes a plate and a mine roof bolt. The plate includes (a) a raised portion defining a cavity; (b) a planar portion extending from the raised portion, wherein the planar portion is configured to be received adjacent the mine roof surrounding the recess; and (c) an opening within the raised portion. A first side of the raised portion is shaped to substantially correspondingly mate with the portion of the mine roof defining the recess.

The mine roof bolt may be a cable bolt having a barrel and wedge assembly. The mine roof bolt includes a drive end that extends through the opening and is at least partially received within the cavity. Alternatively, the cavity of the plate may be sized to substantially receive the entire barrel and drive end therein. A second side of the raised portion of the plate may include a portion surrounding the opening that accommodates a surface of the barrel thereagainst. A top portion of the barrel and wedge assembly may be planar and may conform to a planar surface of the second side of the raised portion of the plate. In another embodiment, the top portion of the barrel and wedge assembly may be contoured (e.g., curved) to conform to the second side of the raised portion of the plate. In yet another embodiment, a spherical washer may be positioned between a contoured surface of the raised portion of the plate and a planar surface of the barrel and wedge assembly. One end of the barrel may define a socket dimensioned to receive a drive tool to impart rotational force thereon.

A method of positioning a drive end of the mine roof bolt at least partially above a roofline of a mine includes (a) drilling a bore hole into the mine roof, wherein the bore hole is sized to receive the mine roof bolt therein; (b) drilling a recess into the mine roof to produce a recessed roofline, wherein the recess is situated below the bore hole and adjacent the roofline; (c) inserting a plate having a raised portion into the recess, wherein the raised portion defines a cavity within the plate, and wherein the recessed roofline matingly receives a first side of the raised portion; (d) inserting the mine roof bolt through an opening in the plate and into the bore hole and the recess of the mine roof; and (e) positioning the drive end of the mine roof bolt at least partially into the cavity. A drill bit tool may be provided having a first drill bit sized to drill the bore hole and a second drill bit sized to drill the recess.

A method of supporting the mine roof includes the aforementioned steps with respect to positioning the drive end of the mine roof bolt at least partially above the roofline of a mine with the addition of inserting a resin cartridge into the first hole and rotating the mine roof bolt. Accordingly, the resin cartridge is ruptured and resin contained therein is released within the bore hole, whereby the resin secures the mine roof bolt within the bore hole.

The drill bit tool for drilling into the mine roof includes a shaft, a first drill bit and a second drill bit. The first drill bit is situated at a first end of the shaft, wherein the first drill bit is sized to drill a bore hole in the mine roof to accommodate a mine roof bolt therein. The second drill bit has a curved cross-section. The second drill bit is positioned on the shaft and is distal from the first end thereof, wherein the second drill bit is sized to drill a recess in the mine roof sized to accommodate the plate therein. The second drill bit is fixedly secured to the shaft. The shaft may include a coupling for removably connecting a portion of the shaft having the first drill bit to a portion of the shaft having the second drill bit. The second drill bit may be movably secured to the shaft by a locking member.

These and other advantages of the present invention will be understood from the description of the preferred embodiments, taken with the accompanying drawings, wherein like reference numerals represent like elements throughout.

DETAILED DESCRIPTION OF THE INVENTION

The present invention will now be described with reference to the accompanying figures. It is to be understood that the specific apparatus and system illustrated in the attached figures and described in the following specification is simply an exemplary embodiment of the present invention.

Figure 2:
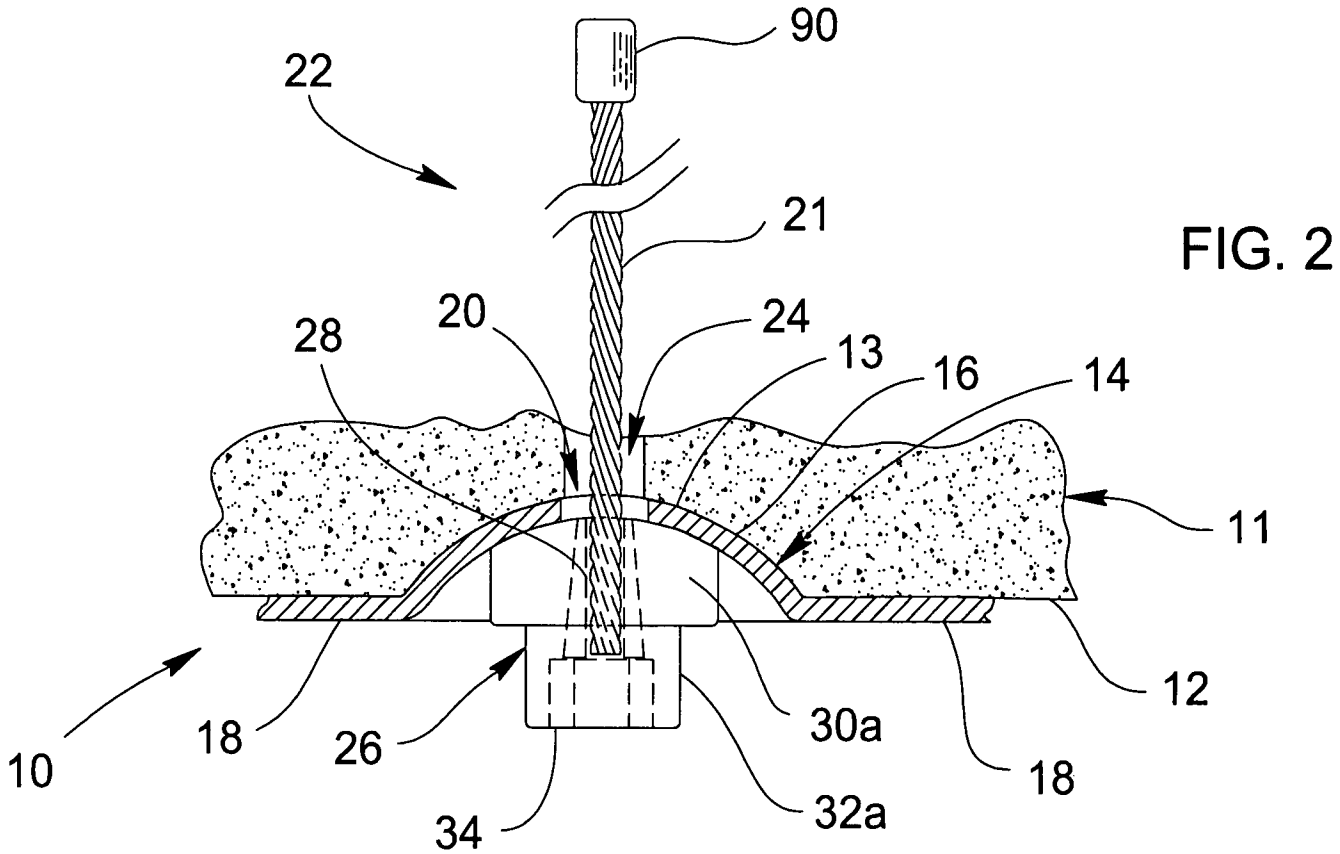
FIG. 2 is a partial sectional view of a mine roof support in accordance with a first embodiment of the present invention.
Figure 3:
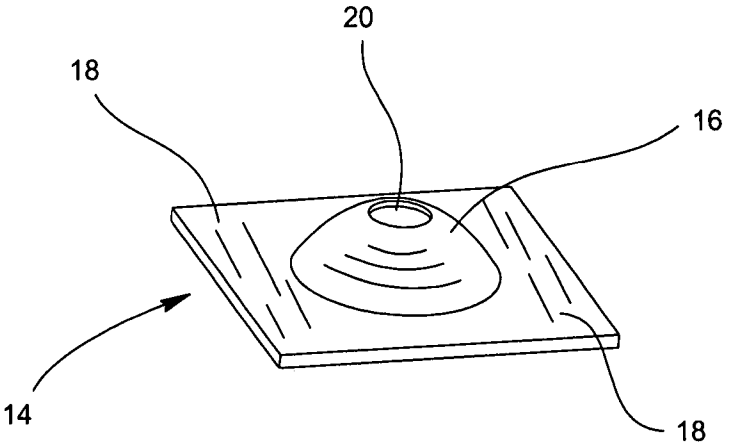
FIG. 3 is a perspective view of a crater plate in accordance with the present invention.
Figure 4A:
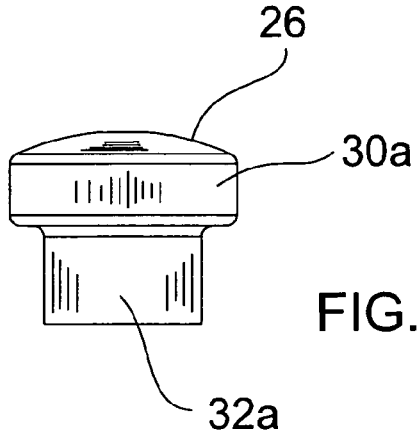
FIG. 4*a* is a side view of a barrel used in connection with the mine roof support of FIG. 2.
Figure 4D:
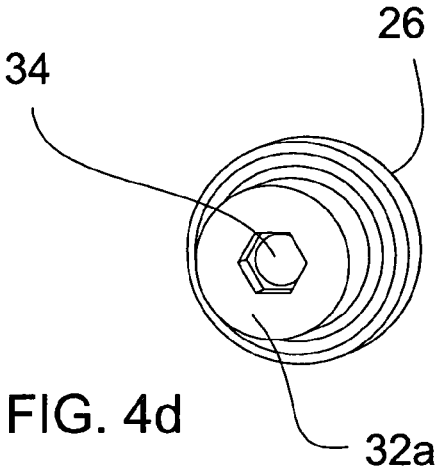
FIG. 4*d* is a lower perspective view of the barrel of FIG. 4*a;*
Figure 4B:
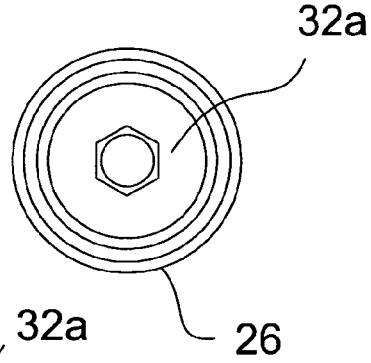
FIG. 4*b* is a bottom view of the barrel of FIG. 4*a;*
Figure 4C:
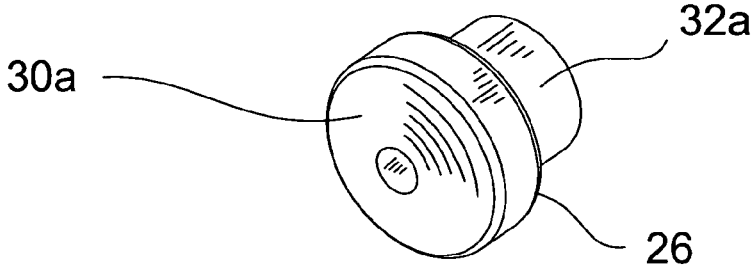
FIG. 4*c* is an upper perspective view of the barrel of FIG. 4*a;*
Figure 5:
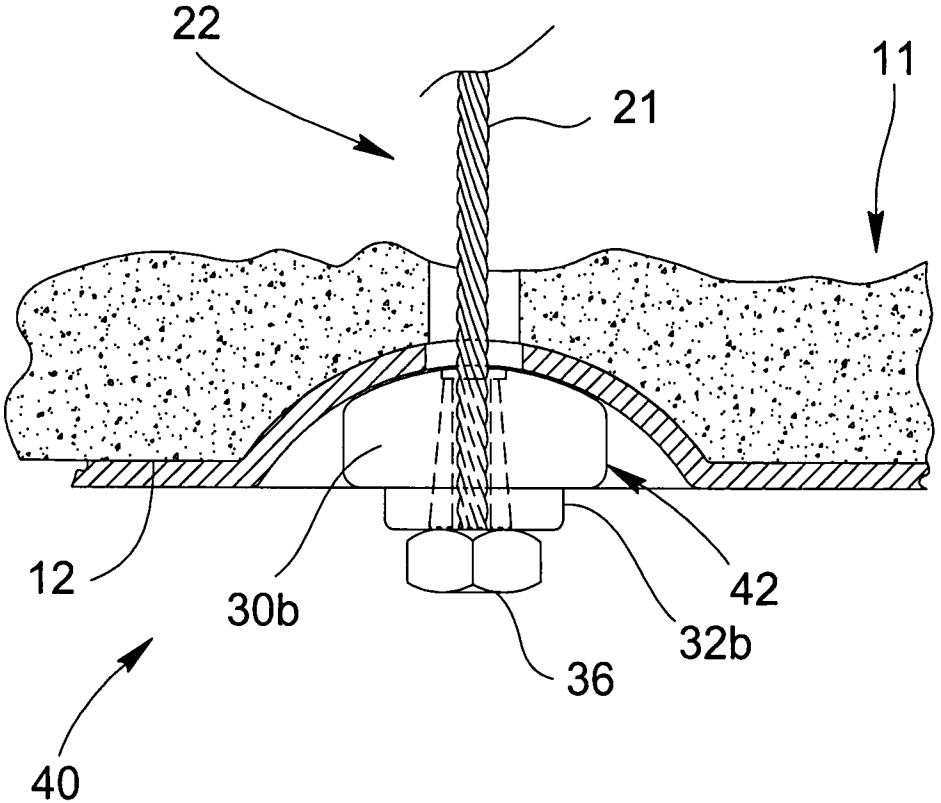
FIG. 5 is a partial sectional view of a mine roof support utilizing a cable bolt in accordance with a second embodiment of the present invention.

With reference to FIG. 2, a first embodiment mine roof support 10 is shown secured to the rock strata of a roof 11 of a mine or other excavated tunnel. A roofline 12 is defined by a lowermost portion of the roof 11. It is to be understood that the term "roofline" may encompass other mining surface areas, including walls. A counter-sunk recess 13, which may have a generally curved profile, such as substantially semi-spherical, and is referenced to herein as a crater sink 13, is formed through the roofline 12 into the roof 11 to accommodate a crater plate or dome plate 14 therein. As shown in FIGS. 2 and 3, the crater plate 14 includes a raised portion 16 that substantially corresponds to the shape of the crater sink 13. Edges 18 extending from the raised portion 16 define the length and width of the crater plate 14. An exemplary crater plate 14 has overall dimensions of eight inches by eight inches; however, it is to be understood that other suitably sized plates may be utilized. Accordingly, the crater plate 14 may be mated with the roof by having the raised portion 16 positioned within the crater sink 13 and the edges 18 positioned against the roof 11 and, more specifically, extending along the roofline 12. By mating the raised portion 16 with the roof 11 surrounding the crater sink 13 (the portion of the roof surrounding the crater sink 13 referred to herein as the recessed roofline), the crater plate 14 exerts pressure or support along its entire upper surface adjacent the roof 11.

The crater plate 14 may be sized to accommodate any angled orientations of an axis of the crater sink 13 with respect to the roofline 12. For example, the depth of one side of the raised portion 16 of the crater plate 14 may be greater than another side of the raised portion 16. In the context of a wall (not shown), a recess would be formed into the wall and, desirably, the edges 18 of the crater plate 14 would be situated substantially parallel with respect to the wall; however, it is to be understood that an axis of the crater sink 13 may be formed in an angled orientation with respect to the plane of the wall.

The crater plate 14 defines an opening 20 to accommodate a mine roof bolt therein. It is to be understood herein that the term mine roof bolt is to encompass a cable bolt, a rod bolt, a torque tension bolt or the like. Therefore, all references made to a cable bolt with a barrel and wedge assembly are to be equally applicable to a rod bolt with head or torque tension bolt with nut, unless specifically indicated otherwise. As used herein, a drive end of a mine roof bolt is not meant to be limiting and may refer to (a) a barrel and wedge assembly (or the like) of a cable bolt; (b) a drive head including a threaded end of either a cable bolt or rod bolt with a drive nut (or the like), such as in a torque tension bolt; and (c) a drive head including a forged head (or the like) of either a cable bolt or rod bolt. In addition, the mine roof bolt described herein may be resin anchored or mechanically anchored using an expansion anchor at the distal end thereof or both. The opening 20 may accommodate a cable 21 of a cable bolt 22 therethrough. In an exemplary embodiment, the opening 20 may be one inch in diameter; however, it is to be understood that the opening 20 may be of various sizes depending on the width of the cable 21. As is known in the art, a bore hole 24 is drilled into the roof 11 to accommodate the cable bolt 22 or other securement mechanism, such as any type of mine roof bolt, therein. The opening 20 of the crater plate 14 is substantially aligned with the bore hole 24 such that a central axis of the opening 20 is substantially co-axial with a central axis of the bore hole 24.

With respect to the first embodiment mine roof support 10 incorporating a cable bolt 22, a barrel 26 is adapted to accommodate one or more wedges 28. As is known in the art, the wedges 28 co-act with the barrel 26 to secure the free end of the cable 21 extending downwardly from the opening 20. One embodiment of the barrel 26 is shown in FIGS. 4*a*-4*d*. Desirably, the barrel 26 is constructed of steel; however, other suitable materials may be utilized. Furthermore, it is to be understood that other shapes and sizes conducive to decreased manufacturing costs, sufficient strength, etc., may be used for the barrel 26. The barrel 26 includes a top portion 30*a* and a bottom portion 32*a*. The top portion 30*a* may be larger than the bottom portion 32*a* and may extend beyond vertical edges defining the bottom portion 32*a*. The top portion 30*a* of the barrel 26 is desirably contoured to correspond to an inner curved portion of the curved raised portion 16 of the crater plate 14. In this manner, the barrel 26 may exhibit a mushroom shape, which may be produced as a casting. The bottom portion 32*a* of the barrel 26 defines a socket 34 dimensioned to receive a correspondingly-sized drive tool (not shown) to mate therewith and impart a rotational force thereon. For example, if the drive tool is hexagonally-shaped, then the socket 34 is also hexagonally-shaped to provide a corresponding fit to the drive tool. It is to be understood that the hexagonal shape of the socket 34 depicted in the accompanying figures is shown for exemplary purposes only and that other shapes may be used to allow the drive tool to engage the barrel 26.

With continuing reference to FIGS. 2, 3, and 4*a*-4*d*, FIG. 5 depicts another embodiment of the present invention. A mine roof support 40 includes many of the same components as used with the mine roof support 10 with the exception of a barrel 42 having a top portion 30*b* configured similarly to the top portion 30*a* of the barrel 26 and a bottom portion 32*b* having a smaller length than the bottom portion 32*a* of the barrel 26 and foregoing the socket 34. Instead, a nut 36 secured to the cable 21 of the cable bolt 22 is situated externally and adjacent the bottom portion 32*b* of the barrel 42. The nut 36 may be secured to the cable 21 by press fitting or the like, such as described in U.S. Pat. No. 6,322,290, incorporated herein by reference. Apart from the socket feature of the first embodiment mine roof support 10, the overall functionalities of the mine roof support assemblies 10 and 40 are similar. However, the reduced length of the bottom portion 32*b* of the barrel 42 minimizes the extent to which the mine roof support assembly 40 extends below the roofline 12.

Figure 6:
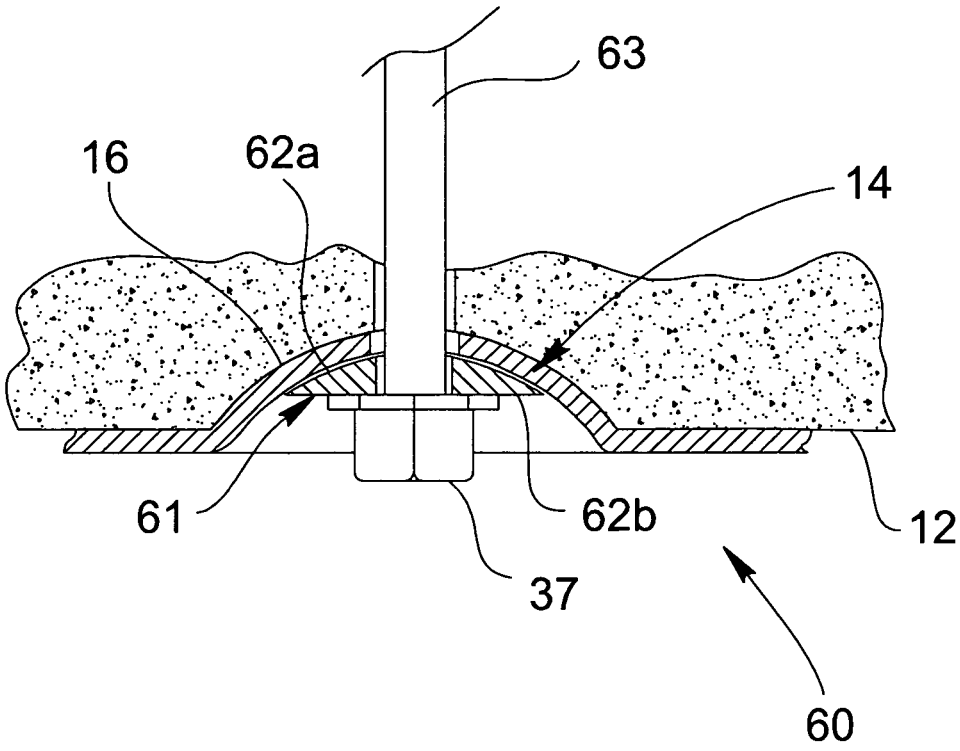
FIG. 6 is a partial sectional view of a mine roof support utilizing a rod bolt in accordance with a third embodiment of the present invention.

With continuing reference to the aforementioned figures, FIG. 6 depicts a third embodiment mine roof support 60 utilizing a spherical or contoured washer 61. In prior art roof plate applications, misalignment of a bolt and plate during installation may generate forces on the plate and end attachment of the bolt and, thereby, reduce overall strength of the support. It is, therefore, desirable to compensate for any such misalignment. Accordingly, the present invention incorporates the use of the spherical washer 61 to provide the desired self-alignment without reliance on other compensating fixtures.

Figure 1:
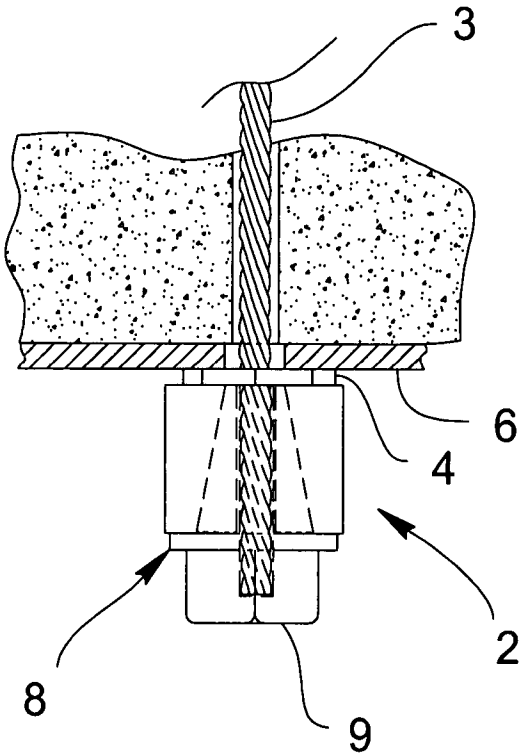
FIG. 1 PRIOR ART
FIG. 1 is a partial sectional view of a prior art cable bolt, wherein the prior art cable bolt protrudes entirely below a roofline.

The spherical washer 61 includes a surface 62*a* that corresponds to the inner curve of the curved raised portion 16 of the crater plate 14 and an opposing surface 62*b* adapted to be seated substantially flush against a surface of a barrel and wedge assembly of a cable bolt. In one desirable embodiment, the top portion of the spherical washer 61 is substantially semi-spherical; however, it is to be understood that the spherical washer 61 may embody any shape that corresponds to the particular shape of the crater plate 14. The spherical washer 61 may be used in connection with either a cable bolt or a rod bolt. For example, as shown in FIG. 6, a rod bolt 63 having a fixed head, such as a nut 37, may be placed substantially flush against the surface 62*b*. The third embodiment mine roof support 60, therefore, may be at least partially above the roofline 12 similarly to the mine roof support assemblies 10 and 40. It is to be understood that the present invention may also be utilized with a cable bolt bearing a conventional barrel and wedge assembly (as shown in FIG. 1), without requiring substitute or specialized barrel forms, such as the barrels 26 or 42. It should be understood that the mine roof support systems described herein (such as systems 10, 40 and 60) may be used in conjunction with an additional bearing plate disposed between the edges 18 and the roofline 12 (with the raised portion 16 extending through an opening therein) for extending the load further to the mine roof 11.

Figure 6A:
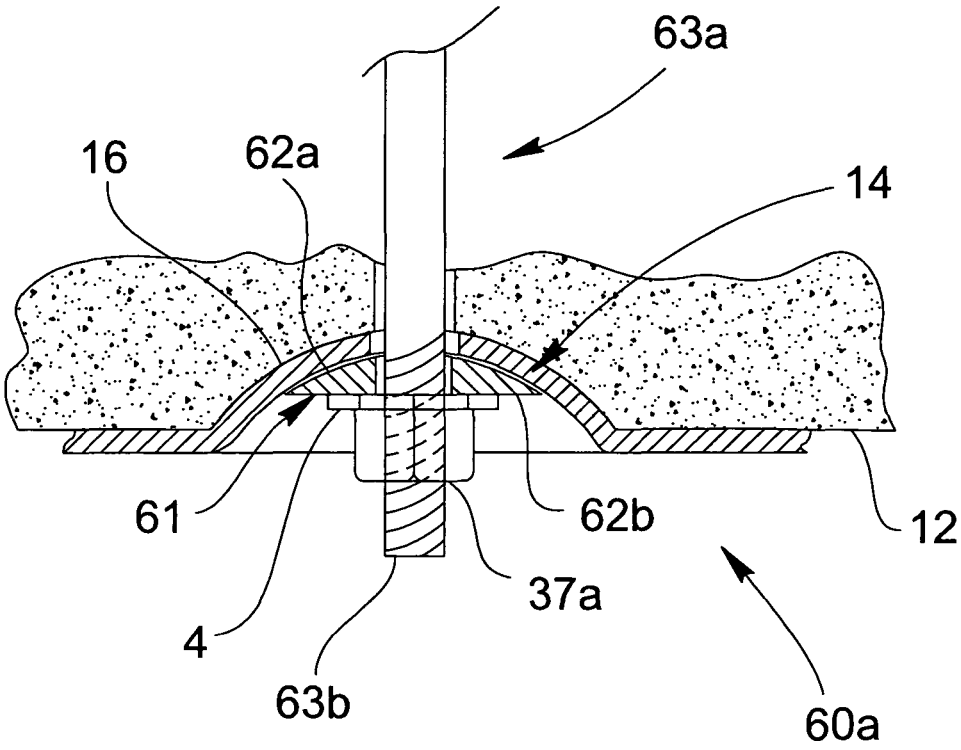
FIG. 6A is a partial sectional view of a mine roof support utilizing a torque tension bolt made in accordance with the present invention.

FIG. 6A shows another embodiment of a mine roof support system 60*a* of the present invention that utilized a torque tension bolt 63*b* and tensioning nut 37*a*, which may be resin anchored or mechanically anchored at its distal end, such as disclosed in U.S. Pat. No. 6,619,888, incorporated herein by reference. The bolt 63*b* may be used with a spherical washer 61 and optional flat washer 4.

Figure 7:
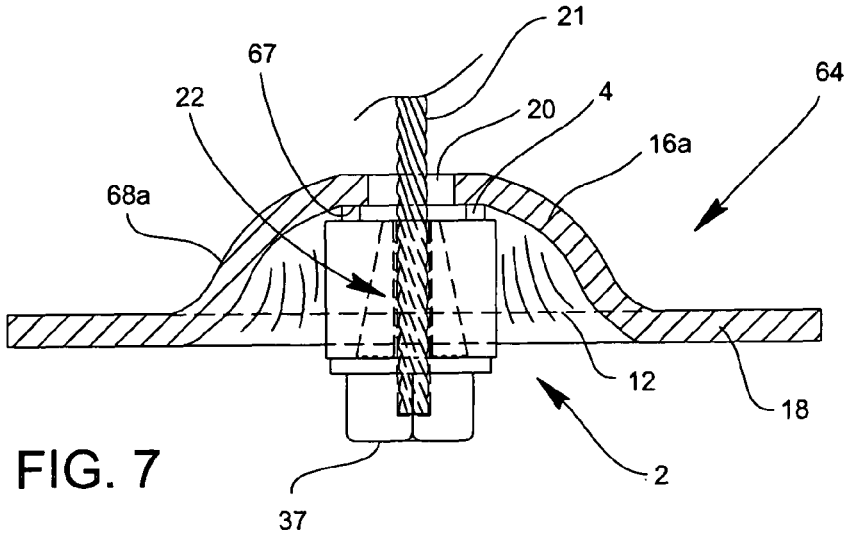
FIG. 7 is a partial sectional view of an alternative embodiment crater plate with a cable bolt partially protruding past the roofline.
Figure 8:
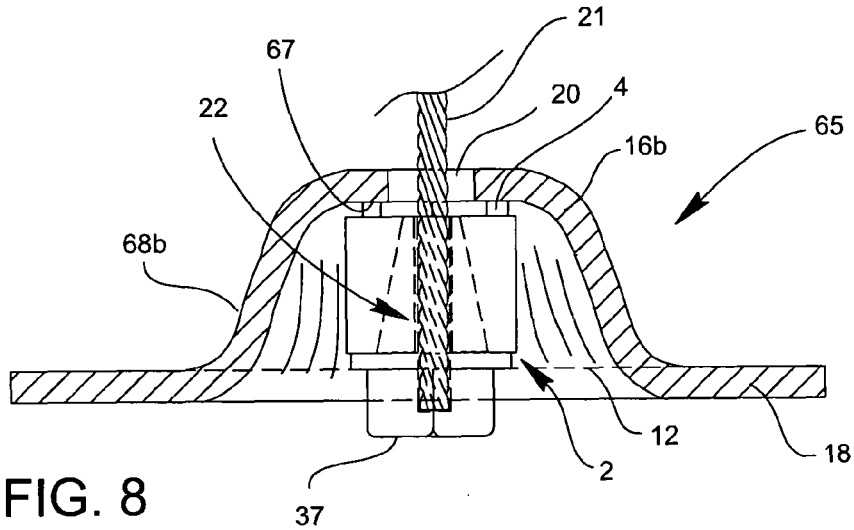
FIG. 8 is a partial sectional view of another alternative embodiment crater plate with a cable bolt slightly protruding past the roofline.
Figure 9:
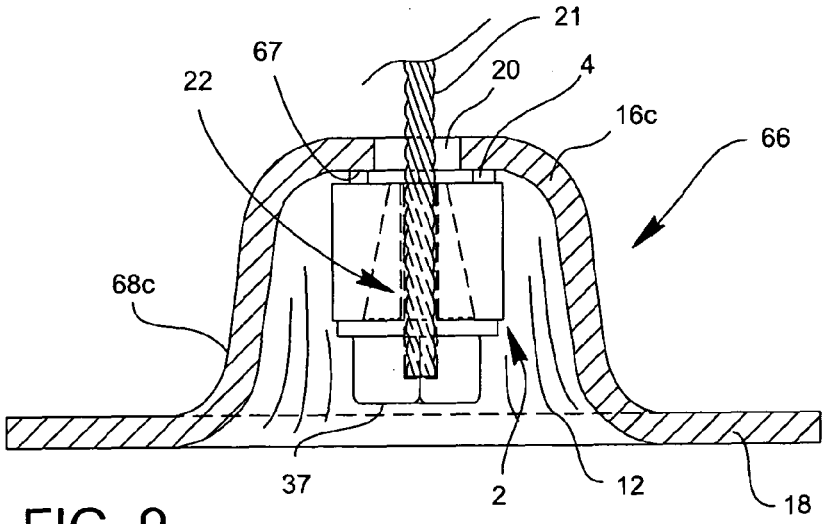
FIG. 9 is a partial sectional view of a third alternative embodiment crater plate with a cable bolt substantially fully recessed above the roofline.
Figure 10:
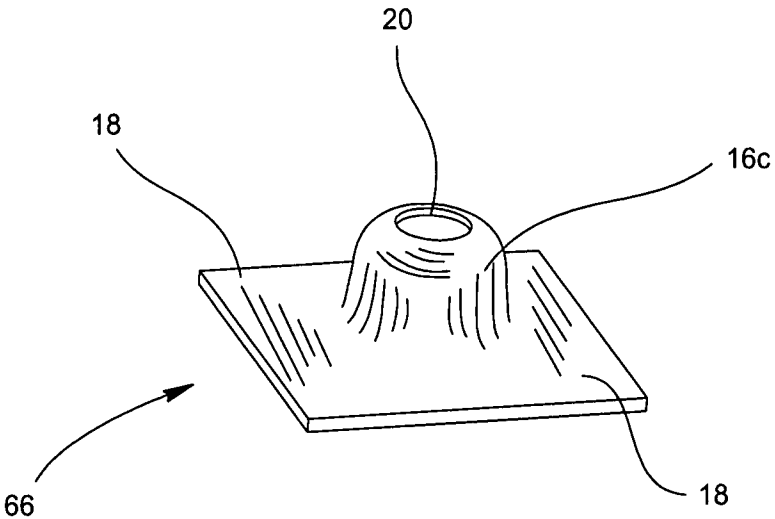
FIG. 10 is a perspective view of the crater plate shown in FIG. 9.

FIGS. 7-9 depict alternative embodiment crater plates 64, 65, 66, respectively. Each of these crater plates 64, 65, 66 serve similar functions as crater plate 14. Accordingly, the crater plates 64, 65, 66 include a respective curved raised portion 16*a*, 16*b*, 16*c*, the edges 18 and the opening 20. However, in contrast to the crater plate 14, in which a distinct intersection point between the raised portion 16 and the edges 18 is defined, the crater plates 64, 65, 66 include corresponding raised portions 16*a*, 16*b*, 16*c* that merge in a curved manner into the respective outlying edges 18. Specifically, the first, second and third alternative embodiment crater plates 64, 65, 66 encompass an uninterrupted curved cross-sectional design. Crater plates 64, 65, 66 each include a substantially flat area 67 defined around the opening 20 that is sufficiently sized to accommodate the end components of a mine roof bolt flush thereagainst. For example, a conventional barrel and wedge assembly 2, as shown in FIG. 7 with or without a washer 4, may be used with the crater plates 64, 65, 66 without the use of the spherical washer 61 or additional hardware. The crater plates 64, 65, 66 differ from each other with respect to the height of the curved raised portions 16*a*, 16*b*, 16*c* in relation to the edges 18. This height establishes the extent of draw associated with production of each of the crater plates 64, 65, 66. As shown in FIGS. 7-9, generally, an increased depth of recess in the crater plates 64, 65, 66 increases the grade or slope of respective sides 68*a*, 68*b*, 68*c* of the curved raised portions 16*a*, 16*b*, 16*c*. As shown in FIG. 10, the crater plate 66 has a larger raised portion 16*c* with a deeper recess than shown for the crater plate 14 of FIG. 3. The length of the edges 18 may be the same or different for each of the crater plates 64, 65, 66. To illustrate the varying degrees of draw, the respective interior heights of the crater plates 64, 65, 66 may be: $1\frac{35}{64}$ inches; $2\frac{9}{32}$ inches; and 3 inches. However, it is to be understood that the aforementioned dimensions are not to be construed as limiting the invention.

Figure 11:
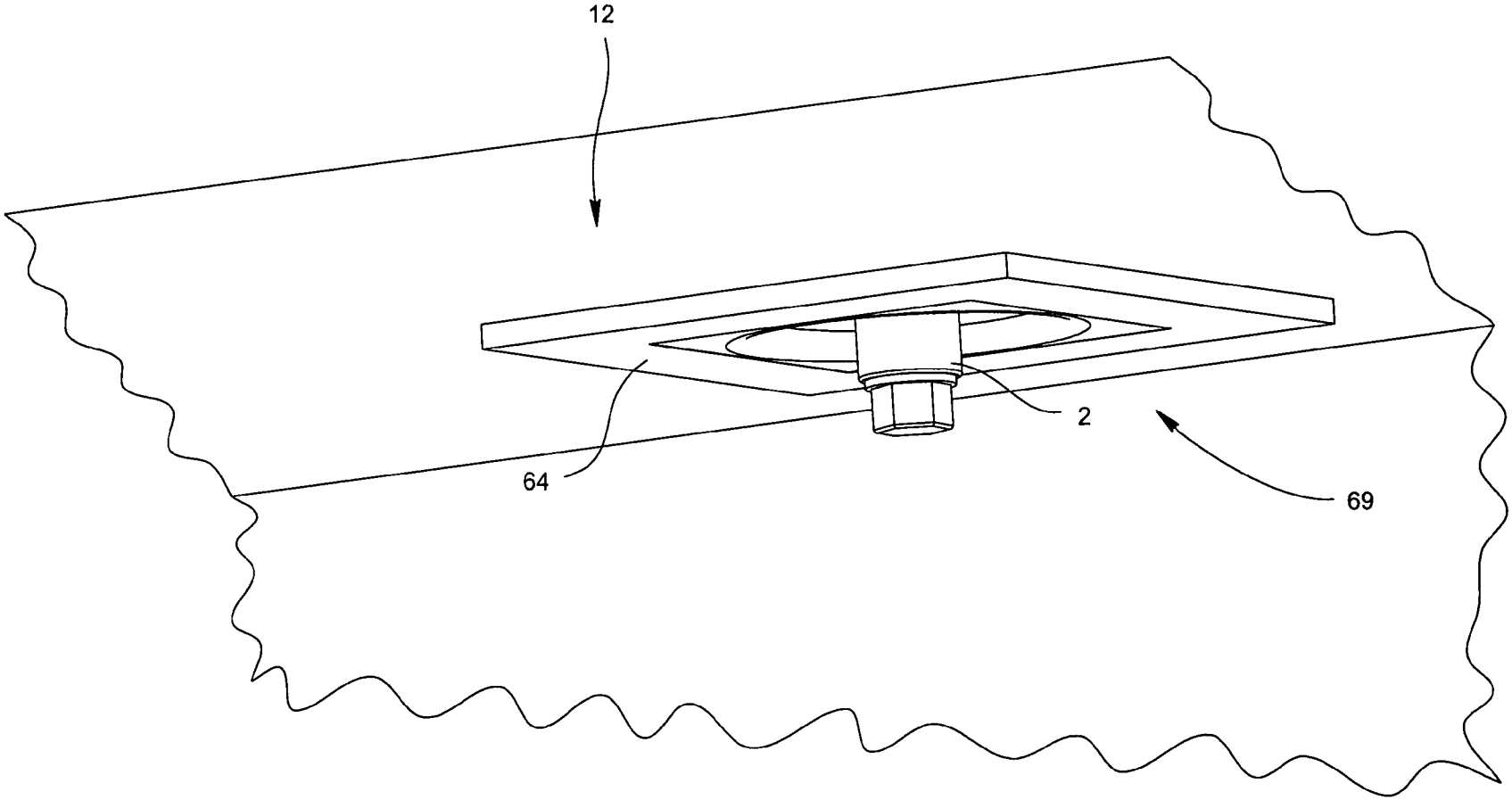
FIG. 11 is a perspective view of an installed mine roof support in accordance with the present invention using the crater plate shown in FIG. 7.

The depth of the recess associated with each of the crater plates 64, 65, 66, can control the extent to which the drive end of a mine roof bolt (a barrel and wedge assembly 2, bolt head, nut or the like) extends below the roofline 12. With reference to FIGS. 7 and 11, for example, approximately half of the barrel and wedge assembly 2 is recessed within the crater plate 64 of a mine roof support 69. Accordingly, a portion of the barrel and wedge assembly 2 still extends below the roofline 12. In contrast, as shown in FIG. 9, approximately the entire barrel and wedge assembly 2 is recessed within the crater plate 66 such that no portion of the nut 37 extends below the roofline 12. It is to be understood that the aforementioned examples of crater plates with varying degrees of draw (depth of recess) are not to be considered as limiting the invention. Accordingly, deeper drawn embodiments of crater plates may be designed to fully accommodate a variety of barrel and wedge assemblies or other mine roof bolting components.

Figure 13:
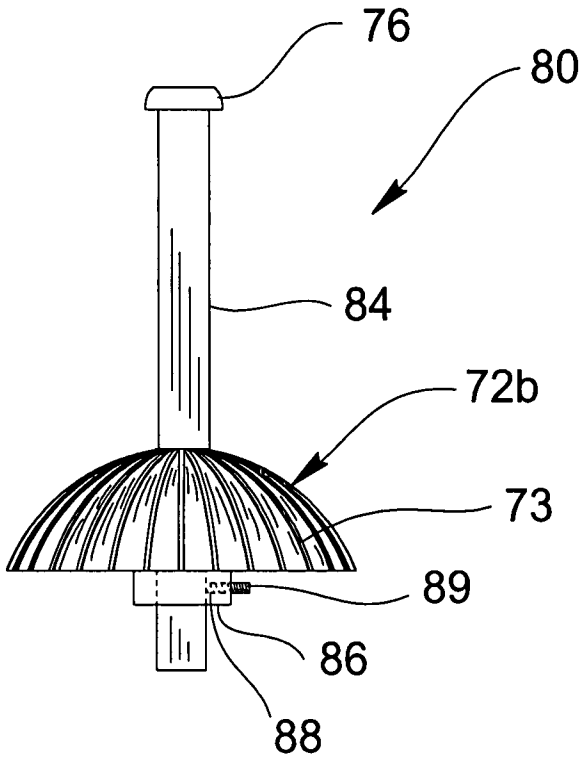
FIG. 13 is an elevation view of another drill bit tool in accordance with the present invention.
Figure 12:
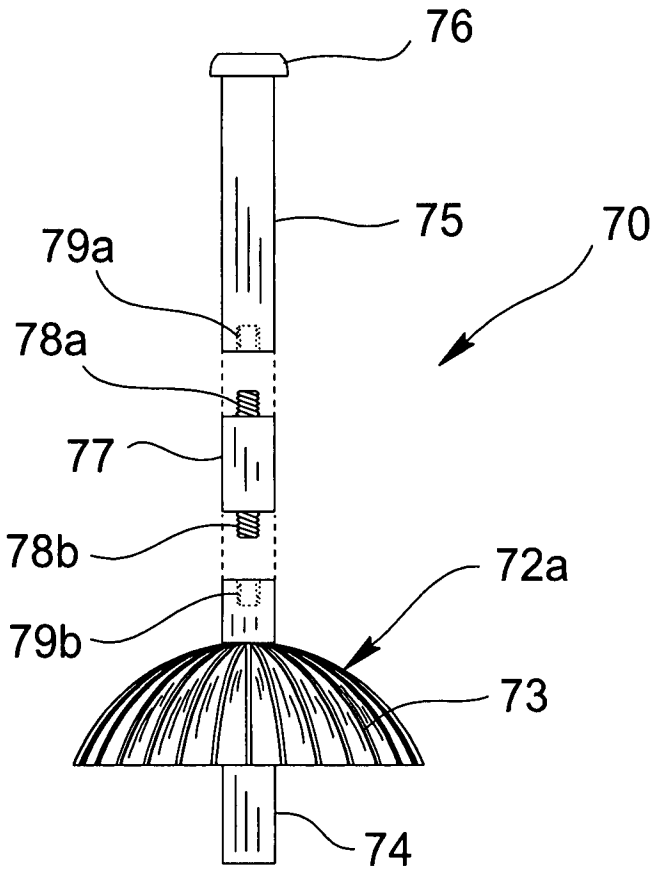
FIG. 12 is an exploded elevation view of a drill bit tool in accordance with the present invention.

With reference to FIGS. 12 and 13, the present invention further includes drill bit tools for forming the crater sink 13 with respect to mining applications. A first embodiment drill bit tool 70 includes a counter bore bit 72*a* fixedly secured to a first drill shaft 74. The counter bore bit 72*a* is sized to create the crater sink 13 such that the crater plate 14 may correspondingly mate therewith. Thus, it is to be understood that the counter bore bit 72*a* may assume various shapes and sizes depending on the type of crater plate 14 utilized. The counter bore bit 72*a* may include raised cutting surfaces or protrusions, such as ribs 73. A second drill shaft 75 with a bore hole bit 76 attached thereon is removably secured to the first drill shaft 74 via a coupling 77. The bore hole bit 76 is designed to drill the bore hole 24 to a sufficient width that may accommodate the cable 21 therein. The second drill shaft 75 may be of various lengths. The coupling 77 may include two male ends 78*b*, 78*a* adapted to be received by corresponding female ends 79*b*, 79*a* of each of the first and second drill shafts 74, 75. Thus, more than one coupling 77 may be utilized to increase the overall length of the first embodiment drill bit tool 70, as needed, depending on the desired depth of the bore hole 24. In the exemplary embodiment shown in FIG. 12, the respective male ends 78*a*, 78*b* and female ends 79*a* and 79*b* include threads for threadably engaging one another. Alternatively or in combination with multiple couplings 77, different lengths of the second drill shaft 75 may be used to achieve the desired depth of the bore hole 24. It is to be understood that other coupling mechanisms may be utilized and that the coupling arrangement disclosed herein is for exemplary purposes only.

A second embodiment drill bit tool 80 is depicted in FIG. 13 and includes a counter bore bit 72*b* that is movably secured onto a drill shaft 84 via a locking member 86 or other suitable engaging mechanism. The counter bore bit 72*b* may be similar to the counter bore bit 72*a* with respect to the raised cutting surfaces or protrusions, such as the ribs 73. The locking member 86 may be a solid component having a throughbore (not shown) sized to receive the drill shaft 84 therethrough. The locking member 86 may include a threaded hole 88 extending through the locking member 86 to the throughbore thereof in a substantially perpendicular relation to the drill shaft 84. A threaded member 89 may be threadably received within the threaded hole 88. The position of the counter bore bit 72*b* with respect to the depth of the bore hole 24 drilled by the bore hole bit 76 may be adjusted by moving the counter bore bit 72*b* at various positions along the drill shaft 84. Thereafter, the threaded member 89 may be tightened against the drill shaft 84 to lock the counter bore bit 72*b* into place. It is to be understood that the coupling 77 may also be utilized in connection with the second embodiment drill bit tool 80.

The aforementioned first embodiment drill bit tool 70 and second embodiment drill bit tool 80 are but exemplary embodiments of drill bit tools that may be used to create the crater sink 13. For example, to form a crater sink that accommodates the crater plate 66, a drill bit sized to correspond to the outer dimensions of the curved raised portion 16*c* of the crater plate 66 may need to be provided. Therefore, it is to be understood that the aforementioned drill bit tools 70, 80 may be modified to provide a correspondingly and suitably sized crater sink to accommodate a correspondingly sized crater plate.

An exemplary installation utilizing the aforementioned components includes selecting a section of wall or roof into which the crater sink 13 is to be formed. Thereafter, the depth of the drill bit tool 70 or 80 is adjusted to form the desired sized bore hole 24. The drill bit tool 70 is then used to drill the bore hole 24 with the accompanying crater sink 13. It is to be understood that the crater sink 13 and the bore hole 24 may be formed using two separate and distinct drill bits. For example, one drill bit (not shown) may be used to form the crater sink 13, whereas another drill bit (not shown) may be used to form the bore hole 24. These two drill bits may, therefore, be used independently of each other to form the crater sink 13 and the bore hole 24. Thereafter, a scraping tool (not shown) or equivalent may be used to prepare the resultant surface of the crater sink 13 to ensure that the respective surface mating areas will provide the requisite alignment between the crater plate 14 and the crater sink 13. The crater plate 14 is placed within the crater sink 13, such that the opening 20 substantially is co-axially aligned with the bore hole 24. A resin cartridge 90 (as shown in FIG. 2) is then inserted into the bore hole 24, preferably urged therein by the mine roof bolt, such as via the cable bolt 22, for example. The cable bolt 22 is inserted through the opening 20 of the crater plate 14. In an exemplary embodiment, the cable bolt 22 is forced upwardly into the bore hole 24 under the force of a bolter boom (not shown), while simultaneously rotating the cable bolt 22 to rupture the resin cartridge 90 and thoroughly mix and distribute the resin adhesive material contained therein. Specifically, the resin adhesive material is forced into the cracks and crevices within the rock formation of the mine roof, and also into the crevices and spaces between the individual strands of the cable 21. After the resin adhesive material is thoroughly mixed, the cable bolt 22 is held in place by the boom for a period of time sufficient to permit the resin to cure. Accordingly, the barrel of the cable bolt 22 is now situated at least partially within the crater sink 13, whereby the barrel is situated at least partially above the roofline 12.

It is to be understood that the dimensions described herein and in the accompanying drawing are for exemplary purposes only and are not to be construed as limiting the invention. As previously discussed, the present invention may be used in the context of rod bolts, torque tension bolts or cable bolts depending upon the mine roof application. While the present invention has been primarily described in reference to use with a cable bolt, rod bolts having a fixed (e.g., forged) head or threaded head (e.g., torque tension bolt) may likewise be employed.

In still another embodiment of the present invention, the plate may be generally planar with the drive end of the mine roof bolt having a surface for mating with the recessed roofline, wherein the drive head partially extends through the plate opening and has a bearing surface retained by the plate.

The present invention has been described with reference to the preferred embodiments. Modifications, combinations and alterations will occur to others upon reading the preceding detailed description. It is intended that the invention be construed as including all such modifications, combinations and alterations insofar as they come within the scope of the appended claims or the equivalents thereof.

The invention claimed is:

1. A mine roof support comprising:

a plate having a semi-spherical raised portion, with a first side and a second side defining a second side profile and defining a cavity and a planar portion directly extending from the raised portion, the planar portion of the plate configured to engage a mine roof, the plate defining an opening within the raised portion; and a mine roof cable bolt having a drive end, the mine roof cable bolt extending through the opening and comprising a barrel and wedge assembly, the barrel and wedge assembly at least partially received within the cavity, a top portion of the barrel and wedge assembly mating with the second side of the raised portion of the plate, the top portion of the barrel and wedge assembly having a profile with a curvature matching a curvature of the second side profile of the raised portion of the plate.

2. The mine roof support of claim 1, wherein the cavity is sized to substantially receive the entire drive end therein.

3. The mine roof support of claim 1, wherein one end of the barrel defines a socket dimensioned to receive a drive tool to impart rotational force thereon.

4. The mine roof support of claim 1, wherein a nut is secured to the drive end of the mine roof cable bolt adjacent to a bottom portion of the barrel and wedge assembly.

* * * * *